US005081396A

United States Patent [19]

Schneider et al.

[11] Patent Number: 5,081,396

[45] Date of Patent: Jan. 14, 1992

[54] AC HIGH PRESSURE DISCHARGE LAMP, ESPECIALLY FOR HIGH CURRENT LEVEL OPERATION

[75] Inventors: Johannes Schneider; Bernd Lewandowski, both of Munich, Fed. Rep. of Germany

[73] Assignee: Patent-Treuhand-Gesellschaft fur elektrische Gluhlampen m.b.H., Munich, Fed. Rep. of Germany

[21] Appl. No.: 467,989

[22] Filed: Jan. 22, 1990

[30] Foreign Application Priority Data

Feb. 15, 1989 [DE] Fed. Rep. of Germany ..... 3904552

[51] Int. Cl.[5] ..... H01J 61/073

[52] U.S. Cl. ..... 313/630; 313/631; 313/633; 313/571

[58] Field of Search ..... 313/630, 631, 633, 570, 313/571

[56] References Cited

U.S. PATENT DOCUMENTS

| | | | |
|---|---|---|---|
| 2,670,451 | 2/1954 | Freeman et al. | 313/570 |
| 2,697,183 | 12/1954 | Neunhoeffer et al. . | |
| 2,965,790 | 12/1960 | Ittig et al. . | |
| 3,988,629 | 10/1976 | White et al. | 313/571 X |
| 4,019,081 | 4/1977 | Buxbaum et al. | 313/346 R X |
| 4,039,883 | 8/1977 | Damsteeg et al. | 313/633 |
| 4,097,762 | 6/1978 | Hilton et al. | 313/633 |
| 4,612,475 | 9/1986 | Downing | 313/571 X |
| 4,906,895 | 3/1990 | Pabst et al. | 313/633 |

FOREIGN PATENT DOCUMENTS

| | | | |
|---|---|---|---|
| 88/09565 | 12/1988 | European Pat. Off. . | |
| 2454569 | 4/1976 | Fed. Rep. of Germany . | |
| 3119747 | 4/1982 | Fed. Rep. of Germany . | |
| 55-155457 | 12/1980 | Japan . | |
| 131457 | 6/1988 | Japan | 313/570 |
| 2107921 | 5/1983 | United Kingdom . | |

*Primary Examiner*—Palmer C. DeMeo
*Attorney, Agent, or Firm*—Frishauf, Holtz, Goodman & Woodward

[57] ABSTRACT

To prevent the formation of melt-back slugs or granules on electrodes of high pressure, high power discharge lamps, when the lamps are operated under alternating current conditions of between about 20 to 60 A, for example, the electrodes are terminated in regions of decreasing diameter and, in accordance with the invention, comprise tungsten doped with lanthanum oxide ($La_2O_3$) between about 0.5 to 2%, by weight, preferably about 1%. The doping intensity may increase towards the inside region of the electrode.

20 Claims, 1 Drawing Sheet

AC HIGH PRESSURE DISCHARGE LAMP, ESPECIALLY FOR HIGH CURRENT LEVEL OPERATION

Cross reference to related patent and application, the disclosure of which is hereby incorporated by reference: U.S. application Ser. No. 07/215,829, filed July 6, 1988, Pabst et al, now U.S. Pat. No. 4,906,895, Mar. 6, 1990 U.S. Pat. No. 4,019,081, Bauxbaum et al.

Reference to related publication German Patent Disclosure Document DE-OS 31 19 747, Awazu et al.

FIELD OF THE INVENTION

The present invention relates to a high-pressure discharge lamp and more particularly to a high-pressure discharge lamp adapted for alternating current operation and intended to operate at high current and power levels.

BACKGROUND

High-pressure discharge lamps usually have electrodes made of tungsten, which is doped with an electron emitting material. The usual doping material is thorium oxide, that is $ThO_2$, see, for example, the referenced U.S. application Ser. No. 07/215,829, filed July 6, 1988, now U.S. Pat. No. 4,906,895, Pabst et al. It has been found that granules or slugs, due to meltback can occur at the end portion of the electrode in types of lamps which operate at very high alternating current levels, for example in the order of between about 20 to 60 amperes. Such slugs, pearls, or granules may occur already comparatively shortly after the lamp operates that is, between about 20 to 100 hours of operation. These granules lead to undesired premature blackening of the inner wall of the lamp bulb. If the size of the granules or pearls exceeds a predetermined value, it cools the remainder of the electrode tip and interferes with the migration of emitting material and with the possibility of the discharge arc to find a new starting point. Overheating of large melt-back granules lead to vaporization of tungsten, which further blackens the lamp bulb.

The foregoing phenomenon occurs only when the current levels are high and the operating pressures are high, which result in constriction of the arc and reduction of the size of the spot or location where the arc forms, thereby increasing the temperature at the said arc spot.

It has previously been proposed to use lanthanum as an electron emitter substance, see, for example, German Patent Disclosure Document DE-OS 31 19 747. According to this disclosure, lanthanum oxide, $La_2O_3$ is used as a component for the emitter paste applied to the filament of a fluorescent lamp. U.S. Pat. No. 4,019,081, Buxbaum et al describes the use of $La_2O_3$ applied to the cathode of vacuum tubes. Neither application of lanthanum oxide, $La_2O_3$ is concerned with the formation of melt-back granules or slugs which may cause blackening of the wall of the discharge vessel; in either case, the current flowing through the cathodes which use the lanthanum oxide are low with respect to the currents of high pressure, high power discharge lamps; likewise, the operating pressures are low.

DEFINITION

"Doping" refers to introducing a trace impurity into ultra-pure material to obtain desired physical properties, especially electrical properties. A dopant is a material which is an imperfection which is chemically foreign to the perfect crystal, an atom within a crystal which is foreign thereto, and introduced into the crystal structure, or, in other words, a crystalline imperfection arising from a deviation from a stoichiometric composition.

THE INVENTION

It is an object to improve high power, that is high current, high pressure discharge lamps by providing an electrode which is so constructed that the bulb will not be blackened by tungsten from the electrode when the lamp is in operation.

Briefly, in accordance with the present invention, lantanum oxide, $La_2O_3$, is used as a doping material for the tungsten electrode.

It has been found, surprisingly, that use of a tungsten electrode doped with lanthanum oxide in high pressure discharge lamps, for example, high pressure discharge lamps with an operating pressure higher than 0.5 MPa which use xenon or mercury in the fill will result in a cycle which has a self-cleaning effect, when the lamp is operated with alternating current. It is a further substantial advantage of the lanthanum oxide that, thereby, the use of radioactive emitting materials such as thorium (Th) can be avoided.

When the lamp is first operated, some blackening of the lamp bulb in the region in front of the cap portions of the electrodes will occur. This blackening, however, disappears after about 50 hours of operation, which is due to the self-cleaning effect. This substantially increases the lifetime of the lamp, so that the lamp, effectively, may have operating lifetimes between for example 600 to 1,200 hours. The self-cleaning phenomenon is more pronounced as the operating current, that is, the power of the lamp, increases.

Surprisingly, experiments with direct current operated lamps utilizing tungsten electrodes doped with lanthanum oxide did not show self-cleaning effects. In comparison to electrodes doped with thorium oxide ($ThO_2$), the operating condition became poorer. The reason for this behavior is not understood. Apparently, operation with alternating current is decisive. The poorer operating behavior with direct current also explains why, in spite of the continuous need to find a replacement for doping of electrodes with radioactive thorium, and in spite of the known suitability of lanthanum oxide in lamps with low current loading, high pressure discharge lamps in which the electrodes are doped with lanthanum oxide did not appear to solve the problem. Specific suitability of lanthanum oxide as a doping material for tungsten electrodes is not apparent in lamps which are only lightly loaded, or operated under current conditions substantially below 20A.

It has been found, surprisingly, that doping the electrodes of high power lamps with lanthanum oxide results in uniformity of light flux throughout the lifetime of the lamp. Such uniformity is especially desirable in many fields of applications, for example for testing of material, simulation of sunlight, illumination of wafers and the like.

The present invention is especially useful for high pressure discharge lamps with an operating pressure between 0.5 and 2.5 MPa operated under high current conditions, and having a fill which includes xenon. The invention is, however, equally applicable to short arc discharge lamps using any noble gas fill, or including mercury in the fill. The end portion of the electrode can be essentially flat, tapering in form of a cut cone, or group of cut cones or frustocones from a cylindrical base structure; it may, also, be rounded, for example, roughly part spherical.

DRAWINGS

FIG. 1 is a highly schematic side view of a long-arc xenon discharge lamp of high pressure and high power, designed for alternating current operation; and FIG. 2 is an enlarged, detailed side view of an electrode used in the lamp of FIG. 1.

DETAILED DESCRIPTION

Figure 1:
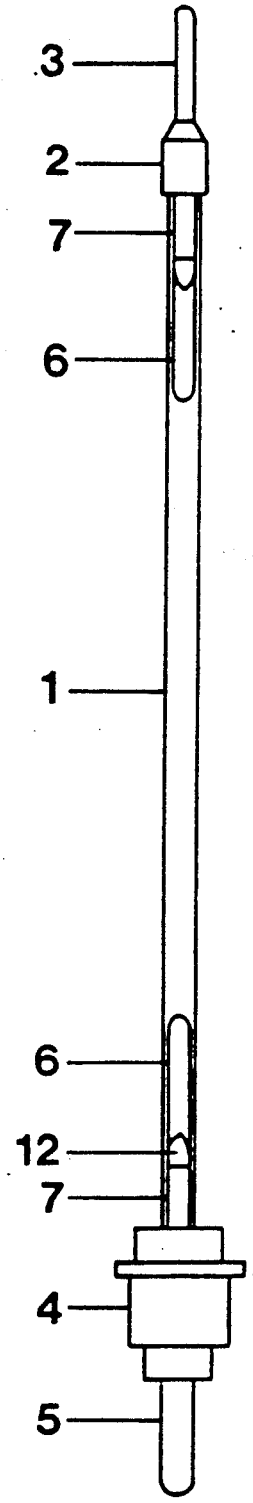

The lamp illustrated in FIG. 1 is a long-arc, high pressure, high power xenon discharge lamp, having, for example, a power of 6,500 W, and operated with alternating current of 35 A. The lamp has an elongated cylindrical discharge vessel 1 with an inner diameter of the bulb, or tube of about 7 mm. The tube or bulb is filled with xenon which, in operation, will have an operating pressure of about 1.5 MPa. The discharge vessel is melt-closed at both ends. On one side, a circular base 2 is secured to the lamp, matched to the outer diameter of the bulb or tube, which then decreases in size to terminate in an axially fitted, contact lug 3. The other end, which is the lower one in FIG. 1, is terminated in a round base of substantially greater diameter than the discharge tube of vessel 1. The associated contact lug 5 also has a larger diameter than the lug 3 at the top side. The lamp is water-cooled and, therefore, is suitably located in a cooling jacket, not shown, since this is well known and standard in such high-powered lamps.

Figure 2:
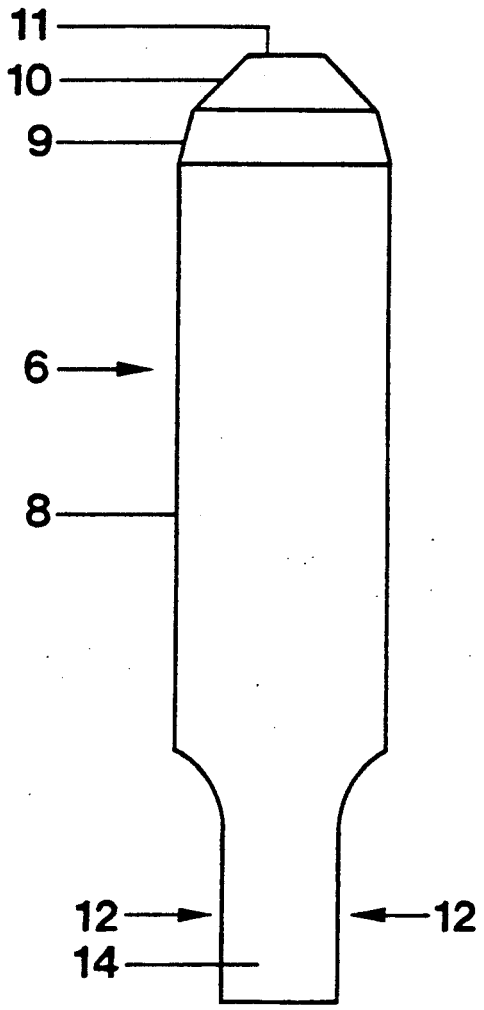

Two electrodes 6 are located interiorly of the vessel. The diameter of the electrode 6 is about 6 mm, and each has an overall length of about 35 mm. The electrodes are spaced from each other by about 16 cm. They are secured in the vessel by means of suitable foil connections 7 and an intermediate disk or element (not visible in the drawings) as well known. Alternate constructions, for example melt connections in which rod-like elements are melted into the vessel are also possible. An enlarged view of one of the electrodes is shown in FIG. 2.

In accordance with the invention, the electrode 6 is a tungsten element doped with about 1%, by weight, of $La_2O_3$. The cylindrical main body 8 tapers at the discharge end, in the form of a frustocone 9, which has a cone inclination of about 10°. The first frustocone 9 merges into a second frustocone 10 with a cone angle of about 45°. The length, or height of the frustocones 9, 10 is approximately the same, and each is about 1.5 mm long. The remaining essentially flat, circular surface 11, on which the arc will form, has a diameter of about 2 mm.

The cylindrical main body 8 is rounded off towards the base on two opposite sides resulting in flat surfaces 12 on which, each, electrically conductive foils are welded, to provide for a double foil melt-through connection to the respective base. The narrow surfaces 14 retain the original distance defined by the diameter of the cylindrical body 8.

Uniformity over time of the operating behavior and especially throughout the lifetime of the lamp is improved if the doping in the electrode is so distributed that the doping increases towards the cylindrical axis of the electrode.

The electrode can be used also in different types of lamps, for example short arc lamps, with mercury or a noble gas fill. The end portion of the electrode need not be a series of frustoconical regions but may be formed, for example, as a part spherical or an otherwise rounded cap.

The amount of doping material, that is, the lanthanum oxide, is preferably in the range of between about 0.25 to 2% by weight, with about 1% being especially suitable.

We claim:

1. A high-pressure discharge lamp rated for alternating current (a-c) operation and at a minimum current level of about 20 A, and especially for high-level alternating current operation, having a discharge vessel (1);

two electrodes (6) located in spaced portions of the discharge vessel, each having an essentially cylindrical body which decreases in diameter at the ends facing the discharge within the discharge vessel;

a fill gas within the discharge vessel; and base terminals (2, 4) secured to the vessel and electrically connected to the respective electrodes, and wherein the improvement comprises that the electrodes essentially consist of tungsten doped with lanthanum oxide ($La_2O_3$) in an amount of up to about 2%, by weight of the tungsten of the electrode.

2. The lamp of claim 1, wherein the lanthanum oxide doping material comprises about 0.25 to 2% by weight of the tungsten of the electrode.

3. The lamp of claim 1, wherein the lanthanum oxide doping material comprises about 1% by weight of the tungsten of the electrode.

4. The lamp of claim 1, wherein the ends of the electrodes facing the discharge, which decrease in diameter, are formed by at least one frustoconical portion.

5. The lamp of claim 1, wherein the ends of the electrodes facing the discharge and decreasing in diameter are formed of two frustoconical portions, including a first frustoconical portion (9) merging into a second frustoconical portion (10) having a cone angle greater than the cone angle of the first portion.

6. The lamp of claim 1, wherein the lamp is rated for operation at current levels about 35 amperes.

7. The lamp of claim 1, wherein the lamp is rated for operation at current level between about 20 to 60 amperes.

8. The lamp of claim 1, wherein the concentration of the lanthanum oxide doping material and hence of the doping increases in the cylindrical body of the electrode from the outside towards the inside thereof.

9. The lamp of claim 7, wherein the lanthanum oxide doping material comprises about 0.25 to 2% by weight of the tungsten of the electrode.

10. The lamp of claim 7, wherein the lanthanum oxide doping material comprises about 1% by weight of the tungsten of the electrode.

11. The lamp of claim 1, wherein the electrodes essentially consist of tungsten doped with about 0.25% to 2% lanthanum oxide.

12. The lamp of claim 11, wherein the lamp is rated for operation at current level between about 20 to 60 amperes.

13. The lamp of claim 12, wherein the concentration of the lanthanum oxide doping material and hence the doping increases in the cylindrical body of the electrode from the outside towards the inside thereof.

14. A high-pressure discharge lamp rated for alternating current (a-c) operation, and especially for high-level alternating current operation, having a discharge vessel (1);

two electrodes (6) located in spaced portions of the discharge vessel, each having an essentially cylindrical body which decreases in diameter at the ends facing the discharge within the discharge vessel;

a fill gas within the discharge vessel; and base terminals (2, 4) secured to the vessel and electrically connected to the respective electrodes, and wherein the improvement comprises an arrangement to prevent the formation of melt-back granules or melting sludge on the electrodes in operation of the lamp under said high level current operating conditions, wherein the electrodes comprise tungsten doped with lanthanum oxide ($La_2O_3$) in an amount of up to about 2%, by weight of the tungsten of the electrode.

15. The lamp of claim 14, wherein the electrodes essentially consist of tungsten and the lanthanum oxide doping material comprises about 0.25 to 2% by weight of the tungsten of the electrode.

16. The lamp of claim 14, wherein the lamp is rated for operation at current levels about 20 to 60 amperes.

17. The lamp of claim 14, wherein the extent of doping of the lanthanum oxide doping material increases in the cylindrical body of the electrode from the outside towards the inside thereof.

18. The lamp of claim 14, wherein the lamp is rated for operation at current levels of about 35 amperes.

19. The lamp of claim 15, wherein the lamp is rated for operation at current levels of about 20 to 60 amperes.

20. The lamp of claim 17, wherein the electrodes essentially consist of tungsten and the lanthanum oxide doping material comprises about 0.25 to 2% by weight of the tungsten of the electrodes; and wherein the lamp is rated for operation at current levels of about 20 to 60 amperes.

* * * * *